US012668933B1

(12) United States Patent
Hagenbuch

(10) Patent No.: US 12,668,933 B1
(45) Date of Patent: Jun. 30, 2026

(54) ROLLING WEDGE CUTTER DRUM

(71) Applicant: LeRoy George Hagenbuch, Peoria Heights, IL (US)

(72) Inventor: LeRoy George Hagenbuch, Peoria Heights, IL (US)

( * ) Notice: Subject to any disclaimer, the term of this patent is extended or adjusted under 35 U.S.C. 154(b) by 163 days.

(21) Appl. No.: 18/437,136

(22) Filed: Feb. 8, 2024

Related U.S. Application Data

(63) Continuation of application No. 17/692,960, filed on Mar. 11, 2022, now Pat. No. 11,933,002.

(60) Provisional application No. 63/159,805, filed on Mar. 11, 2021.

(51) Int. Cl.

| | |
|---|---|
| ***E01C 23/088*** | (2006.01) |
| ***E01C 23/12*** | (2006.01) |
| *E21C 25/10* | (2006.01) |
| *E21D 9/10* | (2006.01) |

(52) U.S. Cl.
CPC ..... *E01C 23/088* (2013.01); *E01C 23/127* (2013.01); *E21C 25/10* (2013.01); *E21D 9/104* (2013.01)

(58) Field of Classification Search
CPC ..... E01C 23/088; E01C 23/127; E21C 25/10; E21C 35/18; E21D 9/104; E02F 9/2866
See application file for complete search history.

(56) References Cited

U.S. PATENT DOCUMENTS

| | | | | |
|---|---|---|---|---|
| 2,730,344 | A | 1/1956 | Cartlidge | |
| 4,448,269 | A | 5/1984 | Ishikawa et al. | |
| 5,338,102 | A | 8/1994 | Lent et al. | |
| 5,662,387 | A | 9/1997 | Bartkowiak | |
| 5,775,781 | A * | 7/1998 | Sawtelle | B28D 1/188 299/39.9 |
| 9,828,742 | B2 | 11/2017 | Hagenbuch | |
| 10,352,163 | B2 | 7/2019 | Hagenbuch | |
| 2004/0124691 | A1 | 7/2004 | Ehler et al. | |
| 2008/0283256 | A1 | 11/2008 | Hall et al. | |
| 2008/0284236 | A1 | 11/2008 | Hall et al. | |
| 2017/0016322 | A1* | 1/2017 | Hagenbuch | E02F 5/06 |
| 2017/0335686 | A1* | 11/2017 | Seibert | E21C 35/19 |

FOREIGN PATENT DOCUMENTS

| | | |
|---|---|---|
| WO | 03/106815 A1 | 12/2003 |

OTHER PUBLICATIONS

Machine translation of Oishi WO-03106815-A1, published Dec. 24, 2003 (4 pages) (Year: 2003).

* cited by examiner

*Primary Examiner* — Carib A Oquendo
(74) *Attorney, Agent, or Firm* — McDonnell Boehnen Hulbert & Berghoff LLP

(57) ABSTRACT

A cutter drum for profiling a surface includes a body extending along an axis from a first end to a second end. The body includes an outer surface encircling the axis. A plurality of first working elements are disposed on the body. Each of the first working elements including a cutter mount attached to the outer surface of the body and a rotary cutter rotatably coupled to each cutter mount of the plurality of cutter mounts. A plurality of second working elements are coupled to the outer surface of the body. The second working elements have a different configuration than the first working elements and are configured to crush material of the working surface.

20 Claims, 15 Drawing Sheets

ROLLING WEDGE CUTTER DRUM

CROSS REFERENCE TO RELATED APPLICATIONS

The present application is a continuation of U.S. patent application Ser. No. 17/692,960, filed Mar. 11, 2022, which claims priority to U.S. Provisional Application No. 63/159,805, filed Mar. 11, 2021, which are hereby incorporated by reference herein in their entirety.

FIELD

The present disclosure generally relates to a drum for profiling a surface such as a road surface or the surface of mineral deposits in a mining operation.

BACKGROUND

Society throughout time has depended on a network of well-maintained roads. The key to modern commerce is the effective movement of goods from point A to point B. Many time sensitive material movements are only possible thru a well maintained infra structure. The importance of roads is often only realized when they fall into disrepair.

Today the preferred materials for road construction and maintenance are concrete and asphalt. Modern engineering anticipates that newly constructed roads will have a life of about twenty-five years, at which time extensive maintenance may be or will be needed. In some instances, road maintenance may require entire road replacement. For example, within the US interstate road system some sections of road are being entirely removed and replaced with new road construction.

This present disclosure is related to systems and methods that may be used for performing road maintenance prior to a complete road replacement.

In the United States most major roads start out as a concrete road. As the road ages and the concrete may develop cracks, the first major maintenance to the aging road is often to apply an asphalt overlay. This asphalt overlayment may be anywhere from one inch to several inches thick.

In applying the asphalt overlay it may be beneficial to remove some of the base concrete or other base material so that the finished asphalt overlaid surface will blend in with existing sections of the road. For example, it may be beneficial for the new asphalt overlayment have substantially the same height as the original road surface. For example, where applying a new overlayment near a bridge underpass, it may be beneficial to match the height of overlayment with the height of the original road surface so as to cooperate with the sections of the bridge underpass.

At a second or third stage in a road's useful life a further asphalt overlayment may be applied as the road surface. In some instances at least a portion of the original asphalt overlayment is milled off prior to the application of a new layer of asphalt overlayment. Further, in some instances, the entire existing asphalt overlayment is milled off, down to the original concrete road, before the application of a new layer of asphalt.

The present disclosure is directed to systems and components that are used in processes to remove layers of road surfaces or other hard surfaces. The process of profiling such a surface may use a profiling machine with a rotating drum that removes the outer layers of the surface to form a new profile. The term profiling, as used herein, may also be referred to as milling, and these types of profiling machines may be referred to milling machines or cold planers. As can be appreciated, in order for a road to withstand the daily use of cars and trucks, road surfaces are typically extremely hard and robust. Accordingly, profiling machines include robust parts and complex engineering design to break apart and remove the hard surface of the road. Further, in addition to profiling road surfaces, some profiling machines may be used to remove layers of other hard surfaces, such as frozen earth, or areas with mineral deposits, for example.

The present inventor has recognized that improvements to profiling machinery, in order to increase efficiency of the profiling machinery, to increase the usable life of the components, or both, would be attractive to customers of such machinery.

SUMMARY

Thus, the present disclosure provides a cutter drum configured to remove hard surfaces that uses at least two types of working elements for removing portions of the surfaces.

In a first aspect, the disclosure provides a cutter drum for profiling a surface, the cutter drum comprising:

- a cylindrical body extending along an axis from a first end to a second end, the cylindrical body including a circumferential outer surface encircling the axis;
- a plurality of cutter mounts attached to the circumferential outer surface of the cylindrical body;
- a rotary cutter rotatably coupled to each cutter mount of the plurality of cutter mounts; and
- a plurality of carbide picks secured to the circumferential outer surface of the cylindrical body, each of the carbide picks having a fixed position relative to the circumferential outer surface of the cylindrical body.

In another aspect, the disclosure provides a surface profiling machine comprising:

- a vehicle propulsion system; and
- a cutter drum including:
  - a cylindrical body extending along an axis from a first end to a second end, the cylindrical body including a circumferential outer surface encircling the axis;
  - a plurality of cutter mounts attached to the circumferential outer surface of the cylindrical body;
  - a rotary cutter rotatably coupled to each cutter mount of the plurality of cutter mounts; and
  - a plurality of carbide picks secured to the circumferential outer surface of the cylindrical body, each of the carbide picks having a fixed position relative to the circumferential outer surface of the cylindrical body.

In another aspect, the disclosure provides a method of profiling a surface, the method comprising:

- positioning a cutter drum against the surface, the cutter drum comprising:
  - a cylindrical body extending along an axis from a first end to a second end, the cylindrical body including a circumferential outer surface encircling the axis;
  - a plurality of cutter mounts attached to the circumferential outer surface of the cylindrical body;
  - a rotary cutter rotatably coupled to each cutter mount of the plurality of cutter mounts; and
  - a plurality of carbide picks secured to the circumferential outer surface of the cylindrical body, each of the carbide picks having a fixed position relative to the circumferential outer surface of the cylindrical body, rotating the cutter drum against the surface such the rotary cutters and carbide picks engage the surface and remove portions of the surface.

These and other aspects of the disclosure will be evident to those of ordinary skill in the art from the following description.

BRIEF DESCRIPTION OF THE DRAWINGS

The present disclosure is described in greater detail below based on the exemplary figures. The figures are not necessarily to scale and certain features and certain views of the figures may be exaggerated in scale or depicted in schematic form for clarity or conciseness. The disclosure is not limited to the exemplary embodiments. All features described and/or illustrated herein can be used alone or combined in different combinations in embodiments of the disclosure. Features and advantages of various embodiments of the disclosure will become apparent by reading the following detailed description with reference to the figures which illustrate the following.

DETAILED DESCRIPTION

As set forth above, the present inventor has recognized that that improvements to profiling machinery, in order to increase efficiency of the profiling machinery, to increase the usable life of the components, or both, would be attractive to customers of such machinery.

In one aspect, the disclosure provides a cutter drum for profiling a surface. As explained in further detail below, the cutter drum may include a cylindrical body and a plurality of working elements around a circumferential outer surface of cylindrical body. The working elements may include both rotary cutters that are rotatably mounted to the cylindrical body as well as carbide picks.

Figure 1:
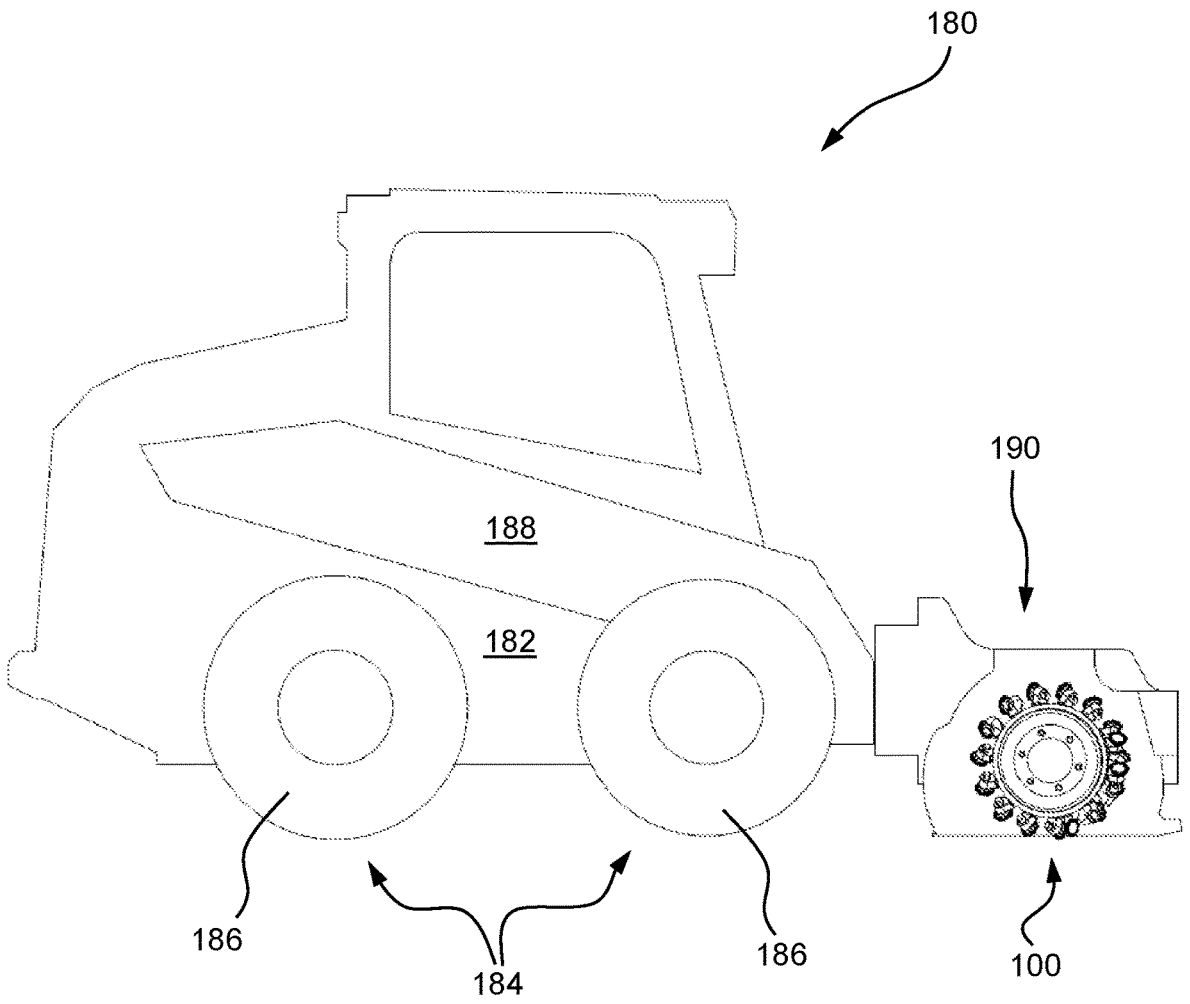
FIG. 1 is a schematic side view of a surface profiling machine according to an embodiment of the disclosure.

In another aspect, the disclosure provides a surface profiling machine that is formed as a vehicle and includes a machine body, a vehicle propulsion system to move the machine body across the surface being profiled, and a cutter drum that includes both rotary cutters and carbide picks. Such a profiling machine 180 is shown in FIG. 1. The illustrated profiling machine 180 is formed as a skid steer loader that includes a machine body 182 that houses an engine or other power source. The machine body 182 is mobile and may be moved using a vehicle propulsion system 184. The profiling machine 180 also includes lift arms 188 that hold a profiling attachment 190. The profiling attachment 190 houses a cutter drum 100, which may be rotated against a material surface in order to remove layers of the surface, as explained in further detail below. The lift arms 188 may be used to engage and disengage the profiling attachment 190 from the material surface. In some embodiments, the profiling attachment 190 is removable from the lift arms 188 so that the skid steer loader can be used with other attachments, such as buckets.

Figure 2:
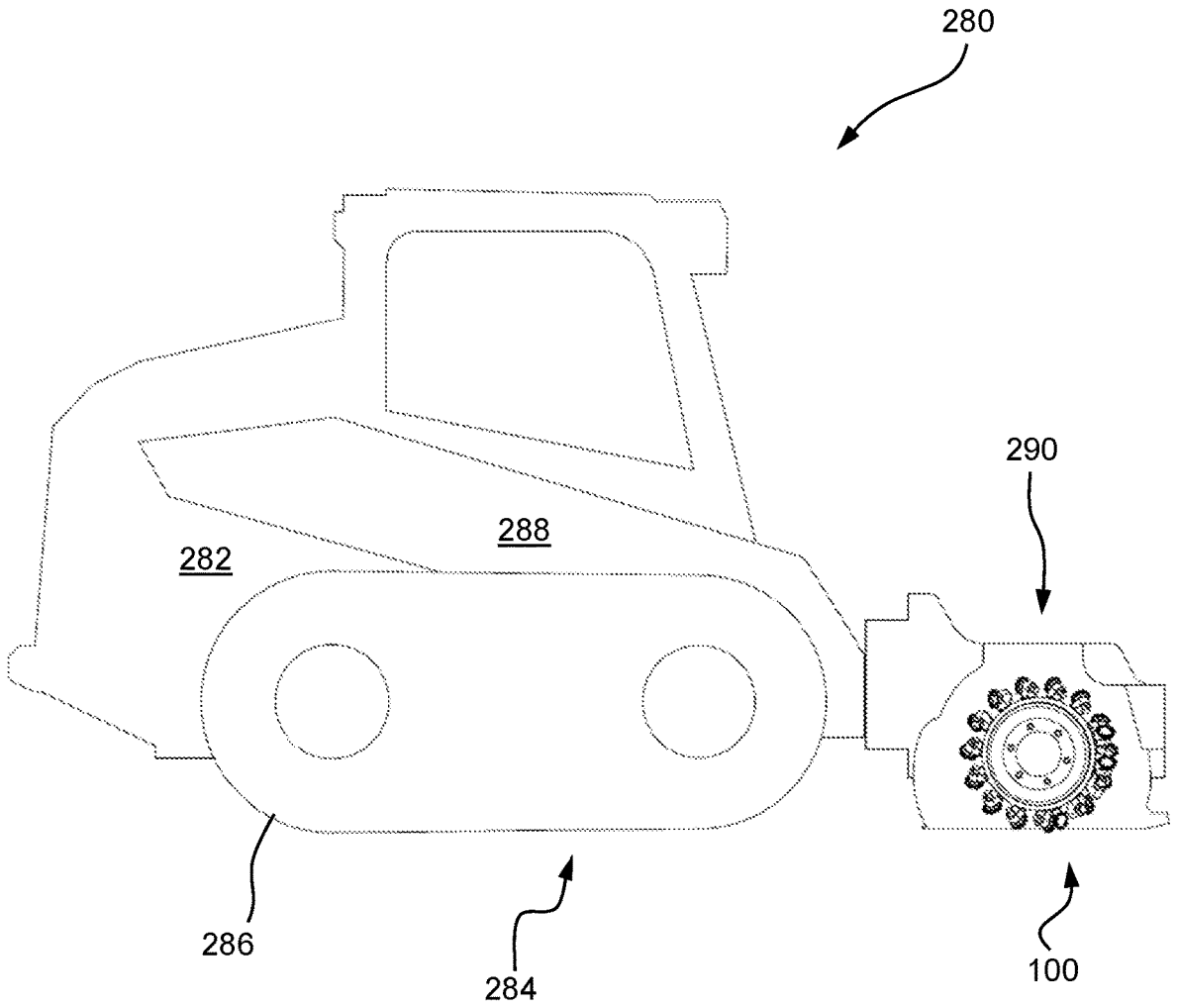
FIG. 2 is a schematic side view of a surface profiling machine according to another embodiment of the disclosure.

In some embodiments, the vehicle propulsion system includes wheels. For example, in profiling machine 180 shown in FIG. 1, the vehicle propulsion system 184 includes an undercarriage with four wheels 186 that are driven to move the machine 180. In other embodiments, the profiling machine may include a different propulsion system. Such a profiling machine 280 is shown in FIG. 2. The illustrated profiling machine 280 is formed as a track loader. Similar to profiling machine 180, profiling machine 280 includes a machine body 282 and lift arms 288. A profiling attachment 290 that includes a cutter drum 100 is secured to the lift arms 288. The profiling machine 280 of FIG. 2 differs in that the vehicle propulsion system 284 includes tracks 286 rather than wheels.

Figure 3:
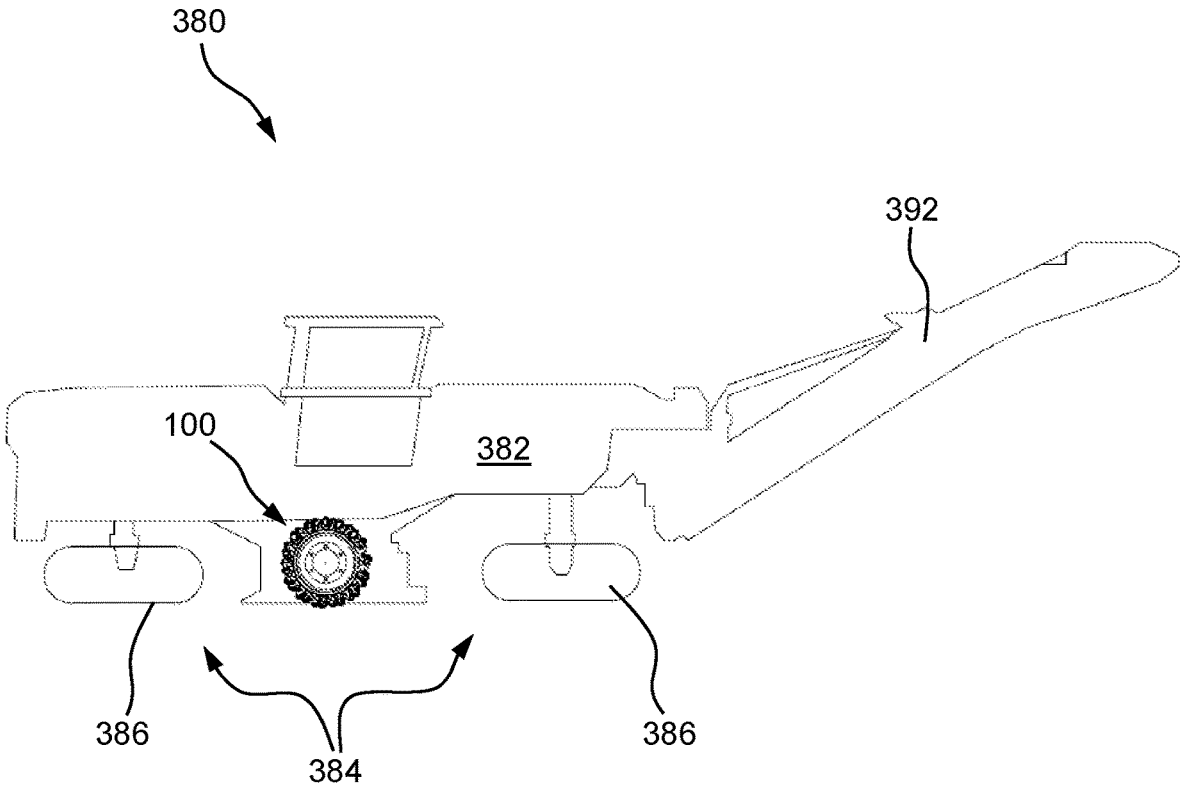
FIG. 3 is a schematic side view of a surface profiling machine according to another embodiment of the disclosure.
Figure 4:
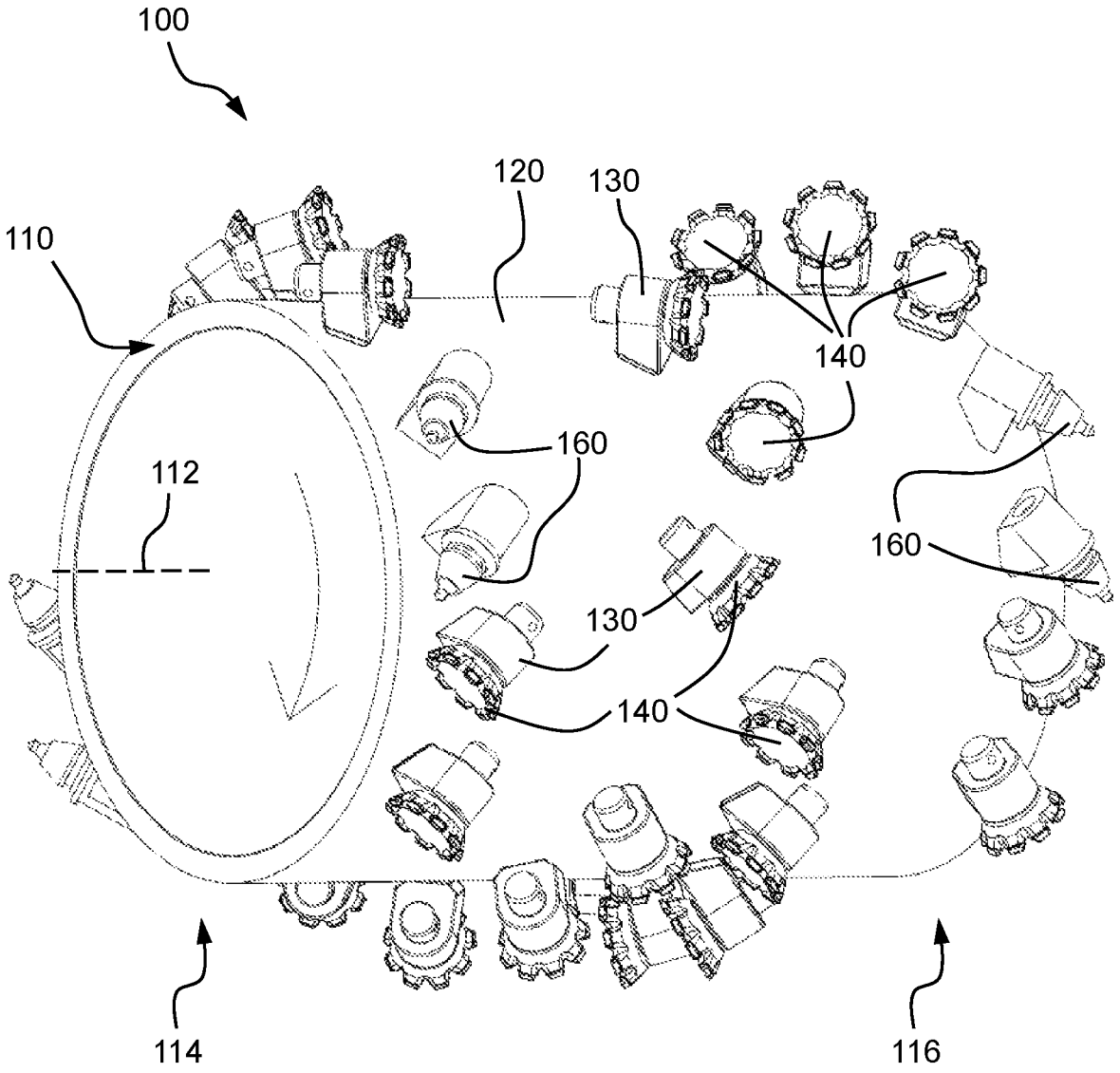
FIG. 4 is a schematic isometric view of a cutter drum according to an embodiment of the disclosure.

In each of the profiling machines shown in FIGS. 1 and 2, the cutter drums have a length of about 36 inches, though in other similar embodiments, the cutter drums may have relatively smaller or greater lengths (Common would be 12-48 inches; 18-24). Of course, in other embodiments, the profiling machine may be larger and include a substantially longer drum. Further, while the cutter drums of the machines of FIGS. 1 and 2 are both incorporated into removable profiling attachments so that the base machine can be used for other purposes, in some embodiments, the machine may be a dedicated profiling machine. Such a profiling machine is shown in FIG. 3. The illustrated profiling machine 380 includes a machine body 382 that is supported on a vehicle propulsion system 384 formed by two track components 386. A cutter drum 100 is provided as an integral part of profiling machine 380 and is positioned underneath machine body 382 toward the middle of the machine. As with the previously described embodiments, the cutter drum 100 is configured to rotate in order to remove layers of a surface that lies under machine body 382. The profiling machine 380 also includes a conveyor 392 that is configured to transport the removed material away from the profiled surface, such as to a transport vehicle. Compared to the embodiments shown in FIGS. 1 and 2, such an embodiment as shown in FIG. 3, of a dedicated profiling machine, may have increased production and allow for wider profiling operations. For example, such a profiling machine may have a significantly longer drum, for example nine feet in length or longer. Such pieces of purpose-built equipment can weigh several tons.

While each of the profiling machines shown in FIGS. 1-3 have the cutter drum positioned to profile the surface that supports the machine, such as the road underneath the machine, in some embodiments, the machine may be configured to profile another surface. For example, in some embodiments, the profiling machine may include the cutter drum on an arm or boom that can be moved to a variety of different positions. Likewise, while the axis of rotation of the cutter drum in each of the illustrated embodiments is substantially aligned with the axis of the vehicle propulsion systems. However, in other embodiments, the cutter drums may be rotated at other angles based on the position or geometry of the surface.

In embodiments of the disclosure, the cutter drum includes a cylindrical body extending along an axis from a first end to a second end. The cylindrical body includes a circumferential outer surface encircling the axis. A plurality of cutter mounts are attached to the circumferential outer surface of the cylindrical body. A rotary cutter is rotatably coupled to each cutter mount of the plurality of cutter mounts. A plurality of carbide picks are secured to the circumferential outer surface of the cylindrical body. Each of the carbide picks has a fixed position relative to the circumferential outer surface of the cylindrical body.

The term cylindrical body, as used herein, refers to a structure including a rounded outer surface that extends along an axis of the body. The shape of the outer surface can be substantially uniform along the length of the cylindrical body, as in an ideal cylinder, or it can vary in shape along the length of the body.

The drum of the disclosure, when used with profiling attachments or profiling machines, such as those shown in FIGS. 1-3 or otherwise, allows for greater rates of profiling production. The profiling action of rotary cutters of the drum operate in a unique manner from conventional profiling. Conventional profiling utilizes only carbide picks, which may be bullet shaped carbide points inserted in a round steel shaft that is held pointed at the surface being profiled. These carbide picks may profile the surface being cut in a percussion impacting manner. Specifically, the conventional carbide picks may overcome the compression or load bearing strength of the material being profiled. However, it is a unique characteristic of most earthen materials, including concrete and asphalt, that they have substantial bearing strengths or compressive carrying capacities. However, place these same load bearing materials in tension and their tensile strength is only a fraction of their bearing strength. Accordingly, a challenge with the use of carbide picks in this crushing percussion mode is the amount of heat generated in the picks. This generated heat is a measure of lost energy in the profiling process. The heat that is generated translates to energy loss. Specifically, energy that cannot be applied to the profiling operation. Another version of conventional carbide picks are wheels that have carbide balls placed around their perimeter and these carbide-tipped wheels are then driven over the surface to be demolished with such downward force to exceed the material's compressive strength and shatter the surface that the carbide balls are applied against.

In contrast to the operation of carbide picks, the rotary cutters included on the cutter drum of the present disclosure are able to remove material through a tensive mode, as explained further below.

FIGS. 4 to 8 illustrate an embodiment of a cutter drum according to the disclosure. Cutter drum 100 includes a cylindrical body 110 extending along an axis 112 from a first end 114 to a second end 116. The cylindrical body 110 includes a circumferential outer surface 120 that encircles the axis 112. A plurality of cutter mounts 130 are attached to the circumferential outer surface 120 of the cylindrical body 110. Each of the cutter mounts 130 supports a rotary cutter 140 that is rotatably coupled to the respective cutter mount 130.

Figure 5:
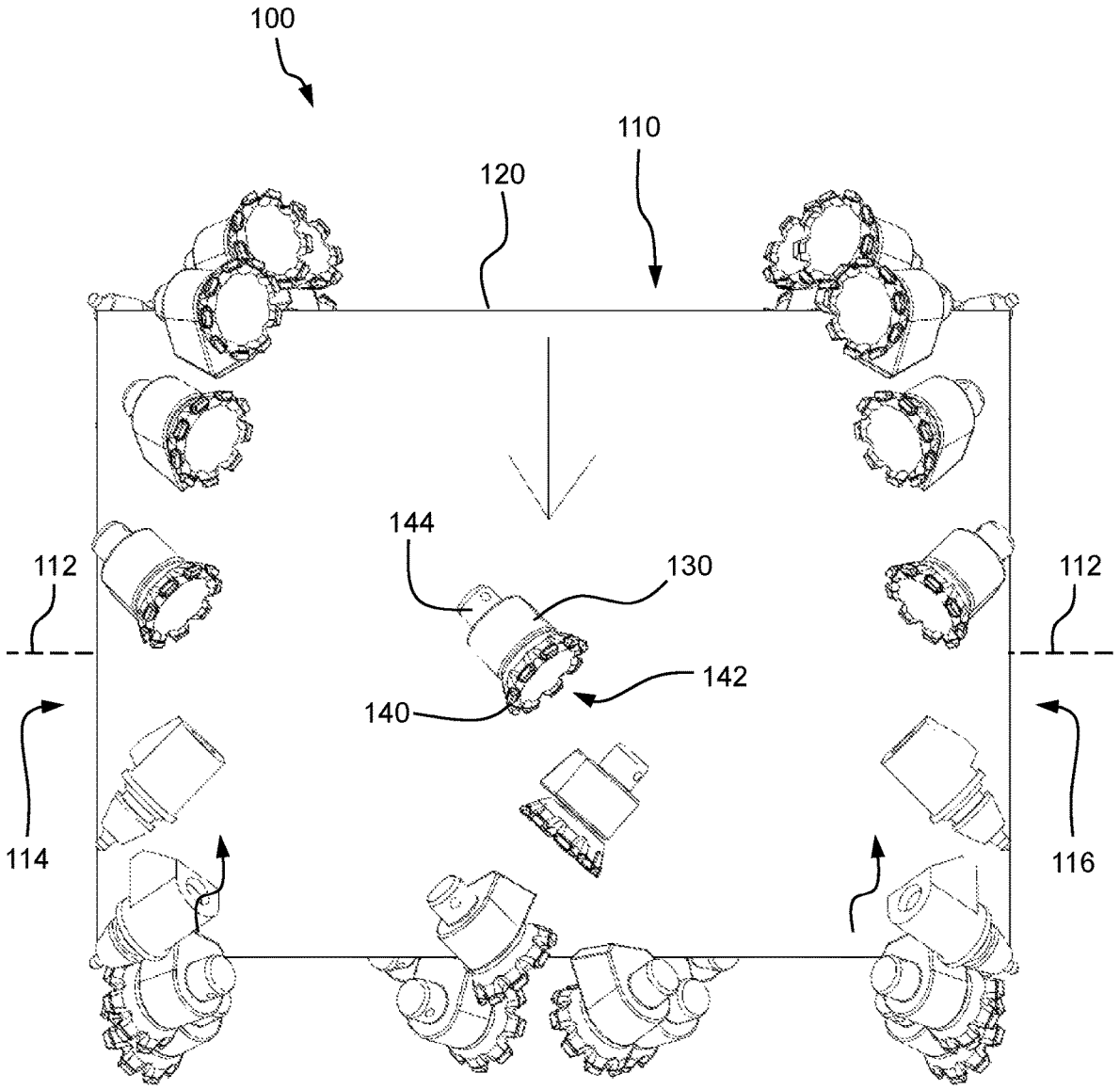
FIG. 5 is a schematic plan view of the cutter drum of FIG. 4.

As shown with respect to the cutter mount 130 at the center of cylindrical body 110 in FIG. 5, each rotary cutter 140 may have a front side 142 and a shaft 144 extend from the back side of the rotary cutter 140. The rotary cutter 140 may be coupled to the cutter mount 130 by the insertion of the shaft 144 through the cutter mount 130. The connection between the shaft 144 and cutter mount 130 may provide a freewheeling connection so that rotary cutter 140 is free to rotate within cutter mount 130, as explained further below. A pin or other fastener may be used to hold the rotary cutter 140 in place within the cutter mount 130. In some embodiments, the rotary cutter 140 may include teeth around the circumference of the front side 142 of the rotary cutter 140. Further, in some embodiments, the teeth may include carbide tips. For example, the rotary cutters may include carbide inserts that are held in receptacles around the circumference of the rotary cutter. Such carbide inserts may form the teeth of the rotary cutter.

Figure 6:
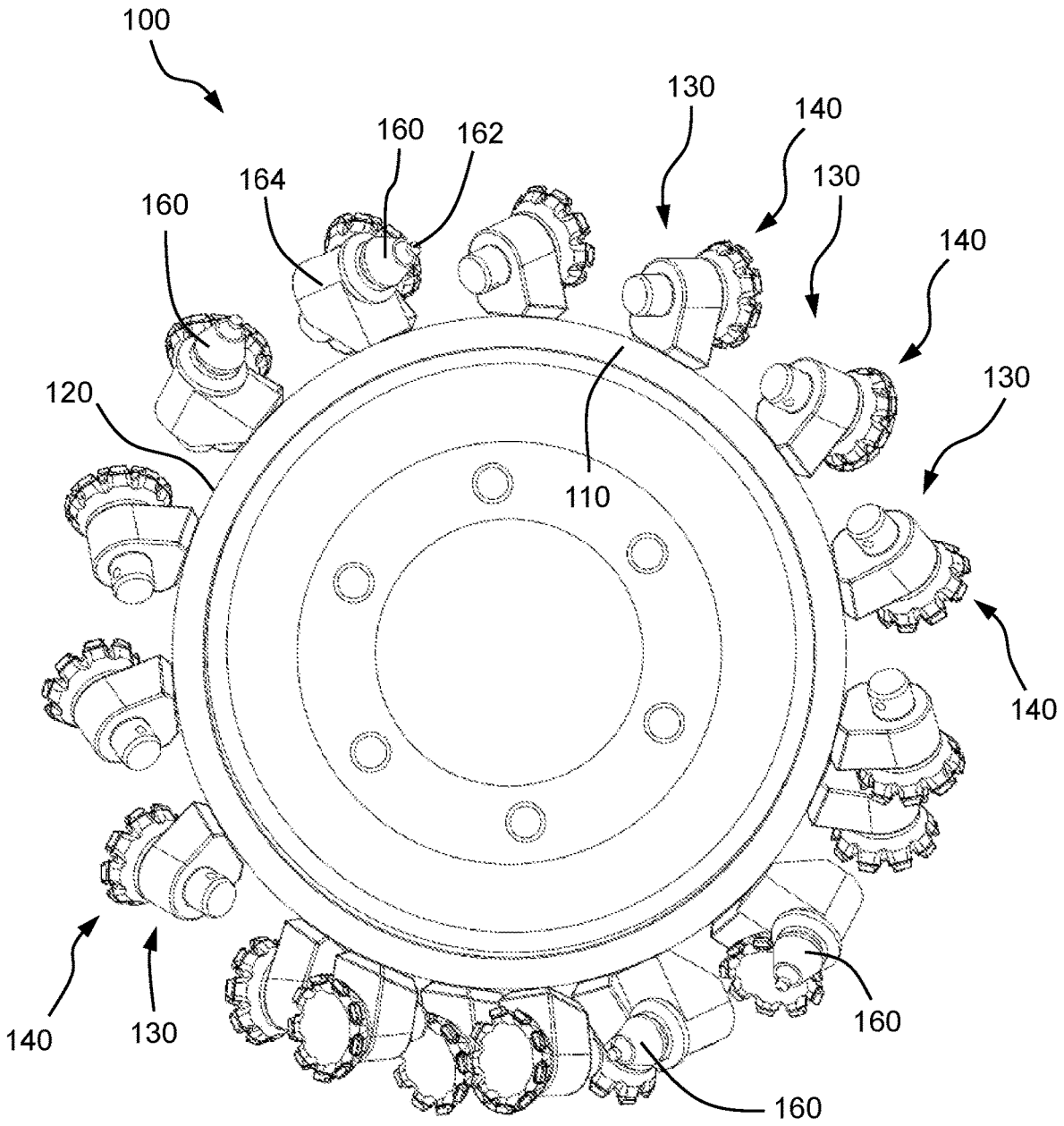
FIG. 6 is a schematic end view of a cutter drum.

As shown in FIG. 6, the rotary cutters 140 may extend around the circumferential outer surface 120 of cylindrical body 110. Accordingly, as the cutter drum 100 is rotated, a sequence of rotary cutters may come into contact with the surface being profiled so as to remove material throughout the rotation of the cutter drum 100.

The cutter drum may also include a plurality of carbide picks 160 secured to the circumferential outer surface 120 of the cylindrical body 110. Each of the carbide picks 160 may have a fixed position relative to the circumferential outer surface 120 of the cylindrical body 110. Thus, while the cutter drum 100 rotates, the carbide picks 160 will move in concert with the circumferential outer surface 120 of the cylindrical body 110 of the cutter drum. The carbide picks 160 may have various forms and shapes. As shown with respect to a carbide pick 160 near the top of the cutter drum in FIG. 6, the carbide pick may include a carbide tip 162 that can be pointed in a desired direction to contact the surface being profiled. For example, the carbide picks 160 may be configured as bullet shaped carbide points that are inserted in a round steel shaft that is held pointed at the surface being profiled. The shaft of the carbide pick 160 may be held in a pick mount 164 that is secured to circumferential outer surface 120 of the cutter drum 100 in a manner similar to the cutter mounts 130.

Figure 7:
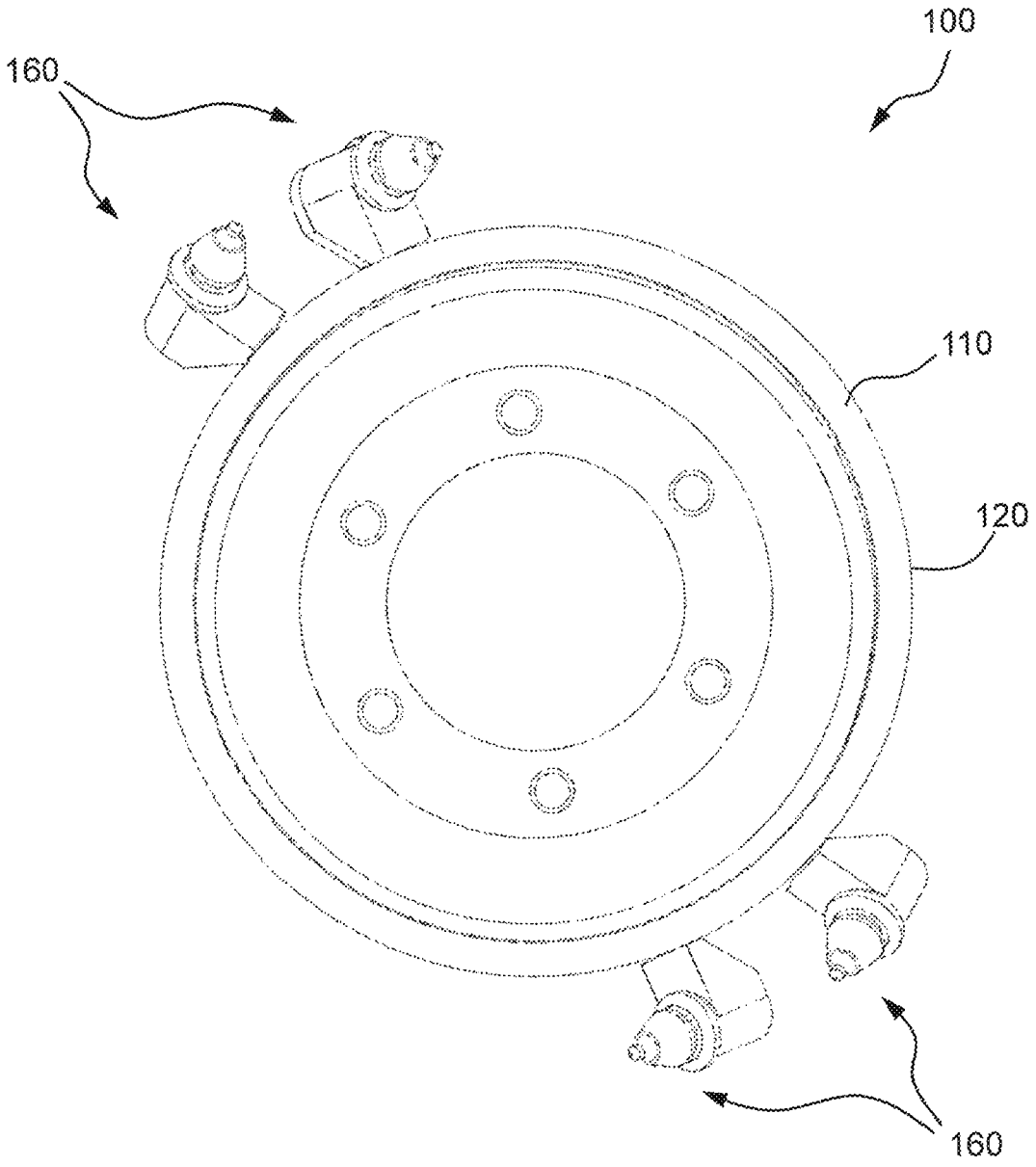
FIG. 7 is a schematic end view of the cutter drum with the rotary cutters removed for clarity.

FIG. 7 shows an end view of the cutter drum 100 with the cutter mounts and rotary cutters removed so that the carbide picks 160 are more visible. As illustrated in FIG. 7, the carbide picks 160 may be positioned on opposing sides of the circumferential outer surface 120 of the cylindrical body 110 so that the opposing carbide picks 160 an engage the profiled surface multiple times with each rotation of the cutter drum. Of course, in other embodiments, the rotary picks may be positioned at regular intervals around the entire circumferential surface, such as every 90 degrees, every 60 degrees, every 45 degrees, every 30 degrees or another interval. Alternatively, the carbide picks may be provided at irregular intervals, or the carbide picks may be concentrated within one angle range around the cutter drum.

In FIG. 7, only the carbide picks 160 at the near end of the cutter drum 100 are visible. However, opposing carbide picks at the opposite end of the cutter drum 100 may be provided in the same angular rotation behind the visible carbide picks 160.

Figure 8:
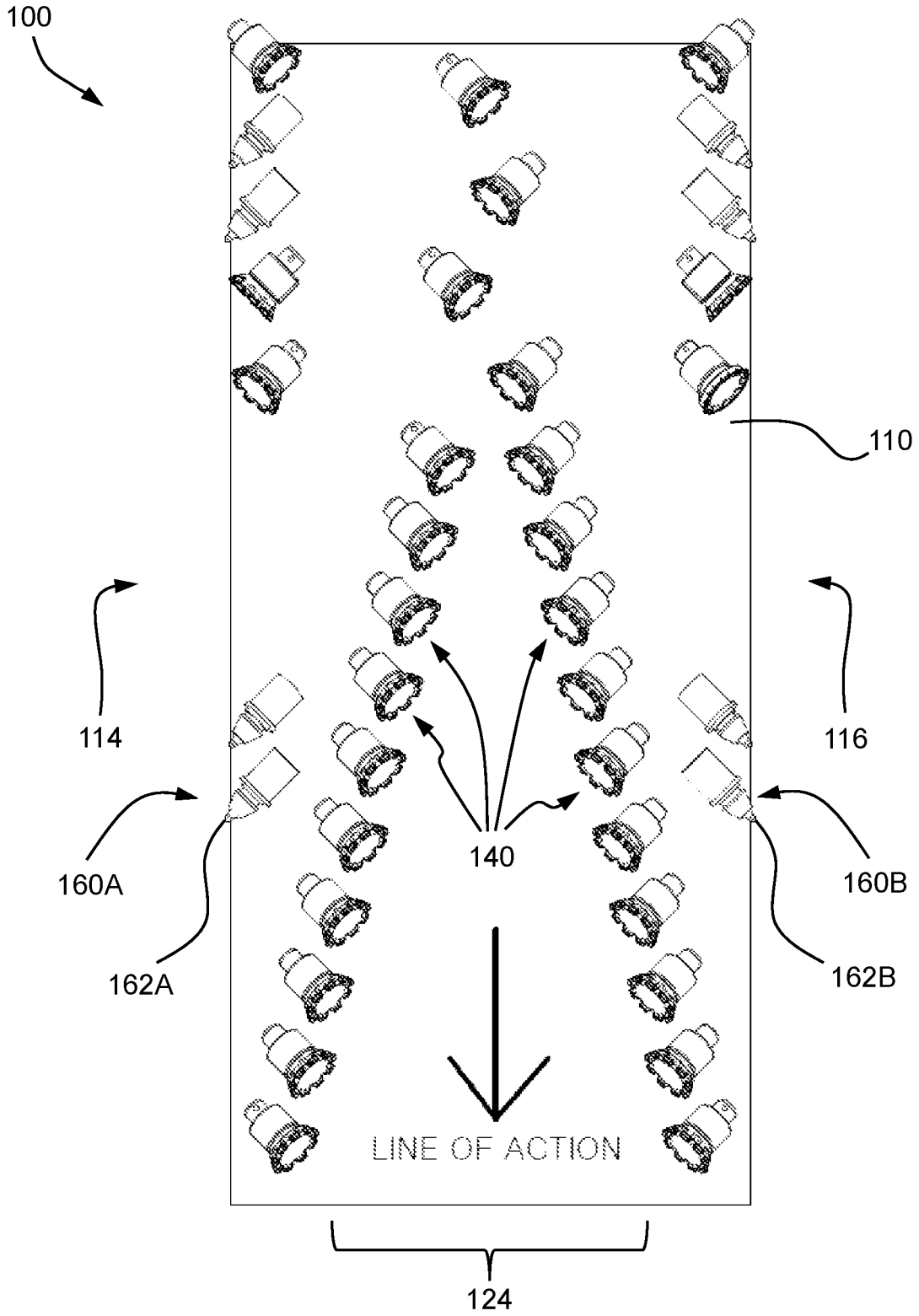
FIG. 8 is a schematic plan view of elements of the cutter drum around a circumference of the cutter drum.
Figure 10:
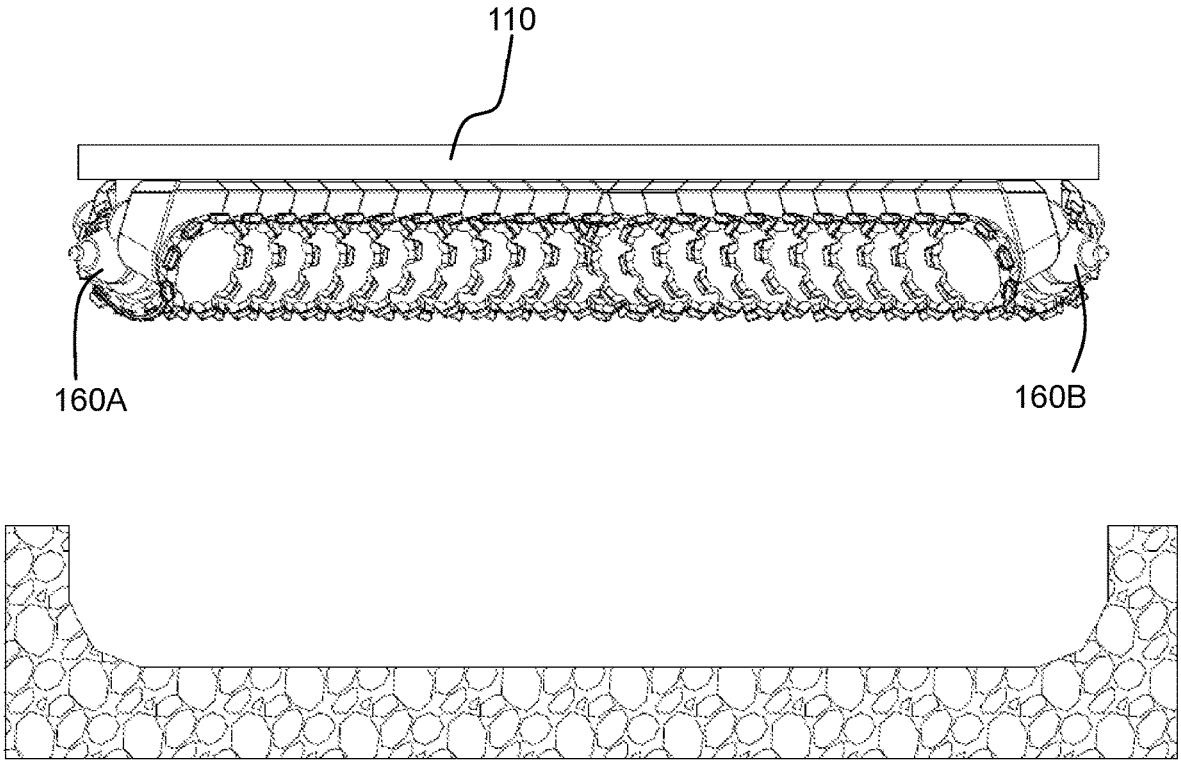
FIG. 10 is a schematic plan view that shows a profile cut by the elements of the cutter drum of FIG. 9A.

FIG. 8 shows a plan view of the complete circumferential outer surface 120 of the cylindrical body 110. The layout of the cutter mounts 130, rotary cutters 140 and carbide picks 160 are shown over the full rotation of the cutter drum 100. While the rotary cutters 140 are shown in a V-shaped pattern in the illustrated embodiment, in other embodiments, the rotary cutters may be arranged in another pattern. For example, the rotary cutters may be positioned in other patterns or configurations that evenly distribute the rotary cutters over the length of the cutter drum and across the width of the cut profile, as shown in FIG. 10.

In some embodiments, the plurality of carbide picks includes a first end pick disposed at the first end of the cylindrical body. For example, as shown in FIG. 8, the illustrated cutter drum 100 includes four carbide picks 160 along the first end 114 of cylindrical body 110. One of these picks has been labelled as first end pick 160A, and is positioned so that the tip 162A of the first end pick 160 is positioned just beyond the edge of the cylindrical body 110 at first end 114. The other carbide picks 160 at the first end 114 are also positioned near this edge relative to the axial direction of the cutter drum. Similarly, carbide picks 160 are also positioned along the second end 116 of cylindrical body 110. This group of carbide picks includes a second end pick 160B that similarly positioned so that the tip 162B of second end pick 160B extends just beyond the edge of cylindrical body 110 at the second end 116 of the cylindrical body 110.

Positioning the carbide picks at the ends of the cylindrical body allows the carbide picks to be used to produce the outer side of the cut profile in the material being profiled. While the carbide picks may not remove the material as efficiently as the rotary cutters, as explained herein, the carbide picks can be made smaller and positioned very precisely, which can allow the carbide picks to form a desired shape at the sides of the profile. The carbide picks can also be placed in front of rotary cutters along the line of action of the rotary cutters, such that the carbide picks protect portions of the rotary cutters or their respective cutter mounts.

Figure 9A:
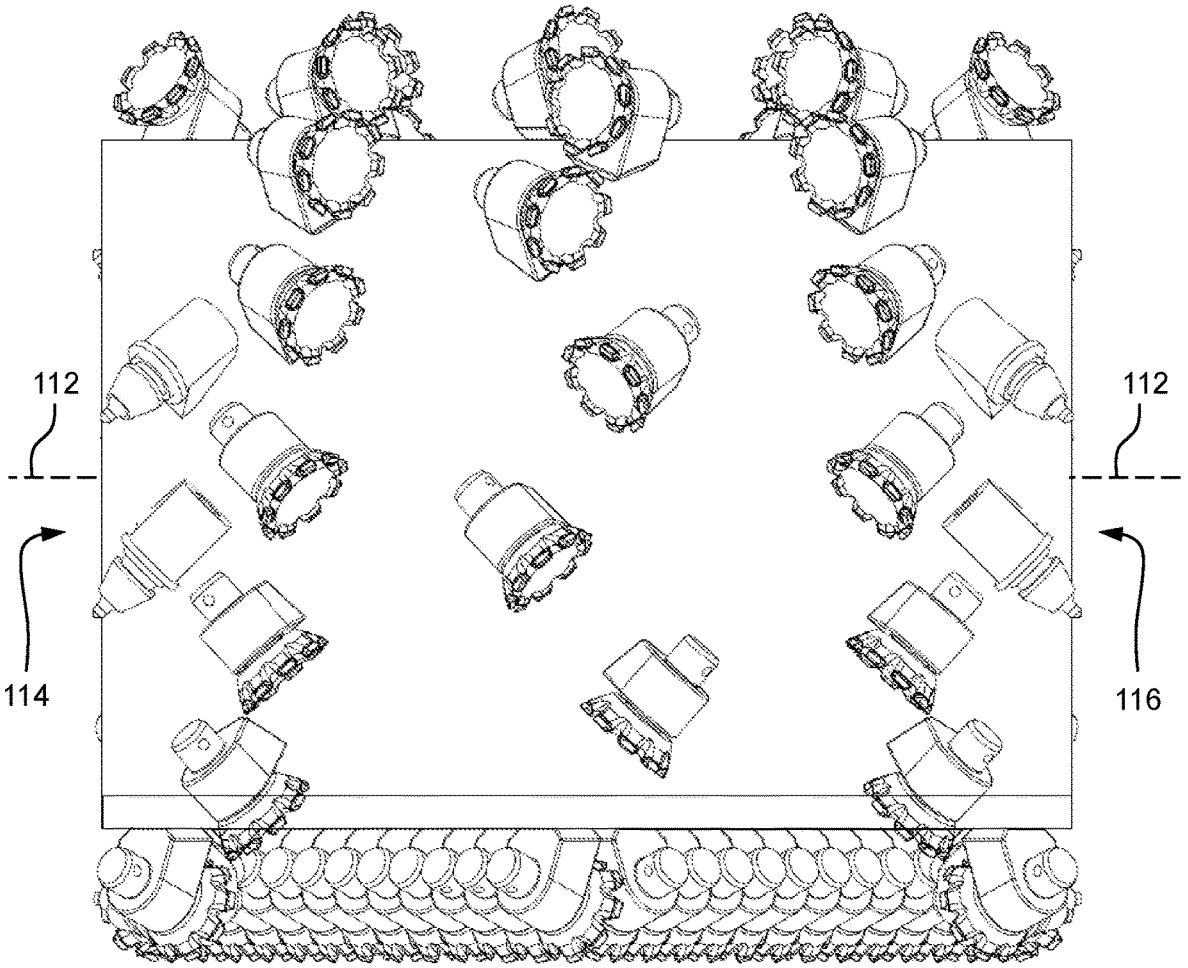
FIG. 9A is a schematic plan view of a cutter drum that shows the position of elements of the cutter drum from a back view over a timed sequence.
Figure 9B:
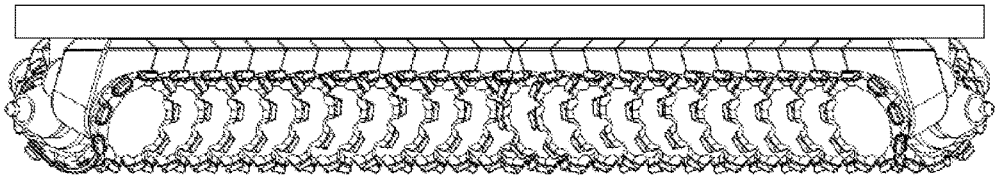
FIG. 9B is a schematic plan view of the cutter drum of FIG. 6A that shows the position of the elements of the cutter drum from a front view over a timed sequence.

FIG. 9A shows a plan view of the cutter drum 100 and a schematic depiction at the bottom of the figure that illustrates the progression of the working elements crossing the visible plane as the cutter drum goes through a full rotation. In the depiction of FIG. 9A, the visible side of cutter drum 100 is rotating downward such that the rotary cutters 140 are viewed from the back along the lower side of the FIG. 9B shows this same progression from the opposing side so that the front side of the rotary cutters is visible.

FIG. 10 is an illustration of the cut profile that is cut in the earthen material as the cutter drum 100 illustrated herein is moved through the earthen material. Of particular interest on this cut profile are the ends of the cut profile shown at the right and left sides of the drawing. As shown, the first end pick 160A and the second end pick 160B are positioned at the opposing ends of the progression of the working elements. Accordingly, the first and second end picks 160A, 160B cut the outer sides of the profile. As shown, the end picks 160A, 160B also provide relief to the trailing edge of some of the rotary cutters 140 positioned near the respective ends of the cylindrical body 110. The depicted cut profile width is directly related to the width of the shown cutter drum.

In some embodiments, the first end pick extends outward along an axial direction of the cylindrical body and away from a center of the drum. For example, as shown in FIGS. 8-10, the first end pick 160A is angled to extend outward along the direction of the axis 112 of the cylindrical body 110. By pointing outward, the tip 162A of the first end pick 160A is arranged to make contact with the material at the outer side of the cut profile. The second end pick 160B is similarly angled to extend outward along the axis 112 in the opposite direction of first end pick 160A. In view of the positioning of the end picks, the outer side of the cut profile may be formed by the carbide picks while the majority of the cut profile is formed by the rotary cutters.

Figure 11:
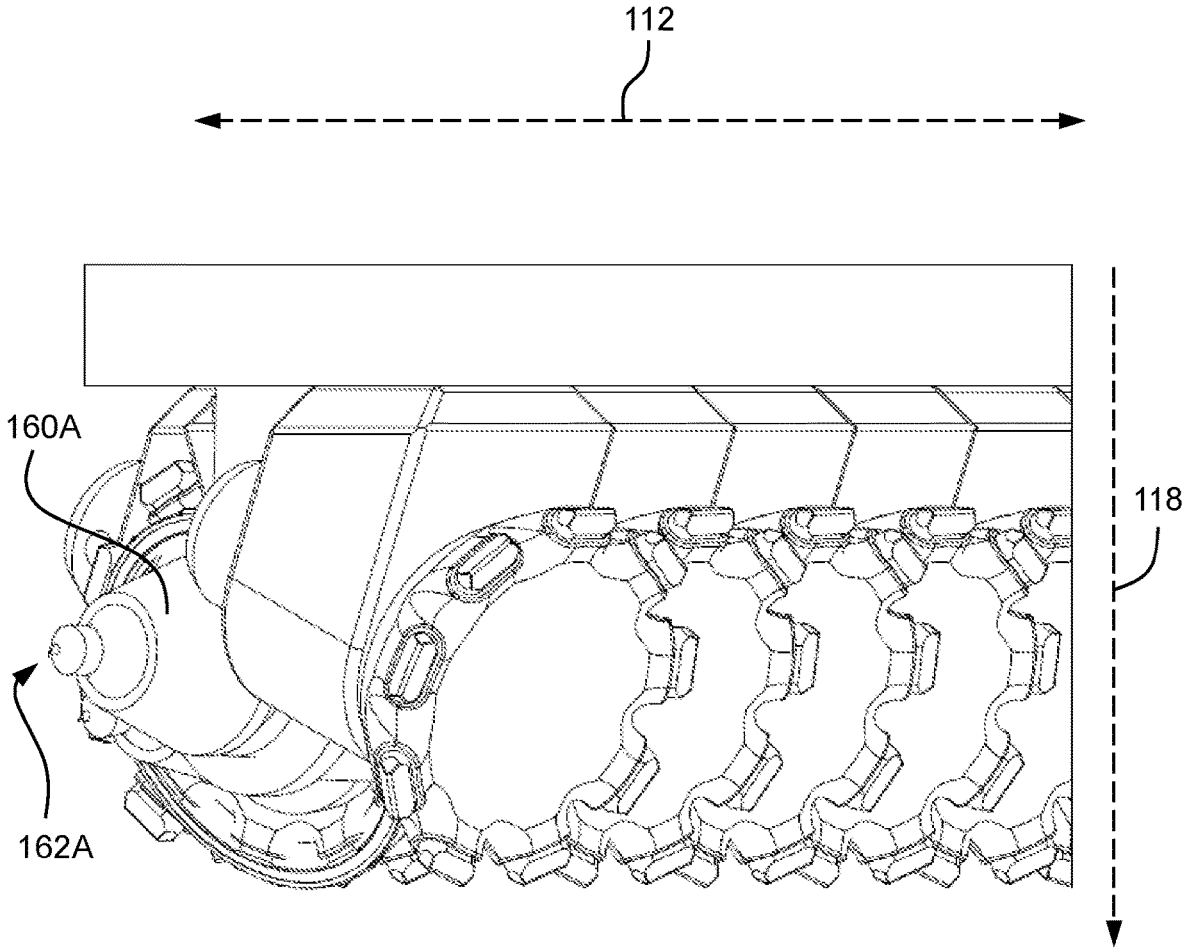
FIG. 11 is a detailed schematic view of a section of the cutter drum.

In some embodiments, a first angle between the first end pick and the axis of the cylindrical body is smaller than a second angle between the first end pick and a radial direction of the cylindrical body. For example, FIG. 11 shows a detailed view of a portion of the projection of the working elements shown in FIGS. 9B and 10. As shown, the first end pick 160A of the cutter drum 100 points substantially outward along the axial direction 112. Accordingly, the angle between the first end pick 160A and the axial direction 112 is smaller than the angle between the first end pick 160A and the radial direction 118 of cylindrical body 110. Indeed, in the illustrated embodiment, the angle between the first end pick 160A and the axial direction 112 in the depicted plane is about zero, while the angle between the first end pick 160A and the radial direction 118 is about 90 degrees. In other words, the angle of the first end pick 160A may have a greater axial trajectory than radial trajectory, such that first end pick points toward the sides of the cut profile more than it points toward the bottom of the cut profile. Alternatively, in other embodiments, the direction of the first end pick may arranged so that the first end pick points radially outward and toward the bottom of the cut profile.

In some embodiments, the plurality of carbide picks includes a second end pick disposed at the second end of the cylindrical body, and each of the rotary cutters is positioned, relative to the axial direction of the cylindrical body, between a tip of the first end pick and a tip of the second end pick. For example, as is visible in FIG. 8, all of the rotary cutters 140 mounted around the cylindrical body 110 are positioned, with respect to the axial direction 112, between the tip 162A of first end pick 160A and the tip 162B of second end pick 160B. Accordingly, the first end pick 160A and second end pick 160B form the working elements positioned furthest along opposing ends of the cutter drum 100.

In some embodiments, the cutter drum includes a central section extending over a portion of the cylindrical body along the axis of the cylindrical body, and wherein the central section is free of any carbide picks. For example, as shown in FIG. 8, the depicted cutter drum 100 includes a large central section 124 that extends over the length of the cylindrical body 110 that does not include any carbide picks. In some embodiments, the central section that is free of carbide picks extends over at least 30 percent of the length of the cylindrical body, or at least 40 percent of the length of the cylindrical body, or at least 50 percent of the length of the cylindrical body.

In some embodiments, a ratio of the number of rotary cutters to the number of carbide picks on the cutter drum is at least 4. For example, in some embodiments, the rotary cutters form the majority of working elements on the cutter drum while the carbide picks are concentrated in small areas, such as at the ends of the cutter drum. Further, in some embodiments the ratio between the rotary cutters and the carbide picks is greater than 4. For example, in some embodiments, the ratio of rotary cutters to carbide picks is more than 5, or more than 6, or even more than 10. Alternatively, in other embodiments, the cutter drum may include a greater number of carbide picks, such that the ratio of rotary cutters to carbide picks is less than 4. Indeed, in some embodiments, there may even be more carbide picks than rotary cutters. Furthermore, in some embodiments, the cutter drum may include other working elements, such as rotating picks or other profiling components Further, the total number of cutting elements used in the illustrated cutter drums is only illustrative. The number of rotary cutters and carbide picks can be varied as required for a particular application or the characteristics of the earthen material being profiled. For example, where the cutter drum is intended to be used on extremely hard materials, the cutter drum may be configured to include a greater number of rotary cutters and/or carbide picks compared to a cutter drum designed to profile softer materials.

FIG. 12A through 12D illustrate an embodiment of a rotary cutter 140 as it moves with the rotation of the cutter drum 100. The views of FIGS. 12A through 12D represent successive rotation of the rotary cutter 140 as the rotating cutter drum 100 moves the rotary cutter 140 in a direction moving toward the viewer, in other words out of the page.

A key difference between the rotary cutter 140 used in the cutter drum 100 of the present disclosure and existing carbide picks is that the rotary cutter 140 pulls and separates the material being profiled while carbide picks crush the material. In particular, carbide picks work with brute force crushing the material. In contrast, the rotary cutters 140 of cutter drum 100 work by rolling against the material being profiled and, in the process, separating the material in a tensive mode. In other words, it is a difference between pulling and crushing the material.

To accomplish the end result, at least some of the rotary cutters may be canted by two angles, such that the rotary cutters are canted with respect to the surface being profiled. For example, in some embodiments, the rotary cutters include a group of rotary cutters that are canted at a side angle such that the front side of the rotary cutter faces a tangential direction of the cylindrical body so as to face a line of action of the rotary cutter as the cutter drum is rotated. Likewise, in some embodiments, this group of rotary cutters may be canted at a tilt angle such that the front side of the rotary cutter faces away from the circumferential outer surface of the cylindrical body. On the other hand, some of the rotary cutters of the cutter drum may be canted at different angles. For example, some of the rotary cutters may have angles configured to target certain locations of the cut profile, such as the sides, or may have particular angles in view of geometric constraints.

Turning to FIGS. 12A through 12D, these figures describe the successive action of one particular tooth "A" of several teeth on a rotary cutter 140 as the cutter mount 130 that carries the rotary cutter 140 is effectively moved forward by the rotation of the cutter drum 100 and is illustrated as if being pulled outward from the page.

As the cutter mount 130 carrying the rotary cutter 140 moves with rotation of the drum, because of the friction between the rotary cutter 140 and the surface being profiled, tooth "A" back rolls over the surface being profiled. As this rotary cutter 140 with tooth "A" rolls backward, tooth "A" simultaneously moves laterally or sideways and perpendicular to the forward movement of the cutter mount 130. Likewise, as tooth "A" moves laterally it also moves vertically into the surface of the material. As tooth "A" both moves laterally and vertically, and freely back rolls relative to the rotation of the cutter drum, tooth "A", being predisposed by the cant angles, is likewise predisposed to the material being profiled.

Tooth "A" is then driven slightly into the surface being profiled. As the cutter mount 130 carrying the rotary cutter 140 continues moving with rotation of the drum, tooth "A" is both further driven laterally into the material being profiled while at the same time tooth "A" begins to rotate upward away from the material being profiled, thereby putting the material being cut in tension and breaking the material's bond. As the cutter mount 130 carrying the rotary cutter 140 further rotates with the cutter drum 100, each successive tooth on the rotary cutter 140 after tooth A may repeat the cutting and pulling action demonstrated by tooth A.

Figure 12A:
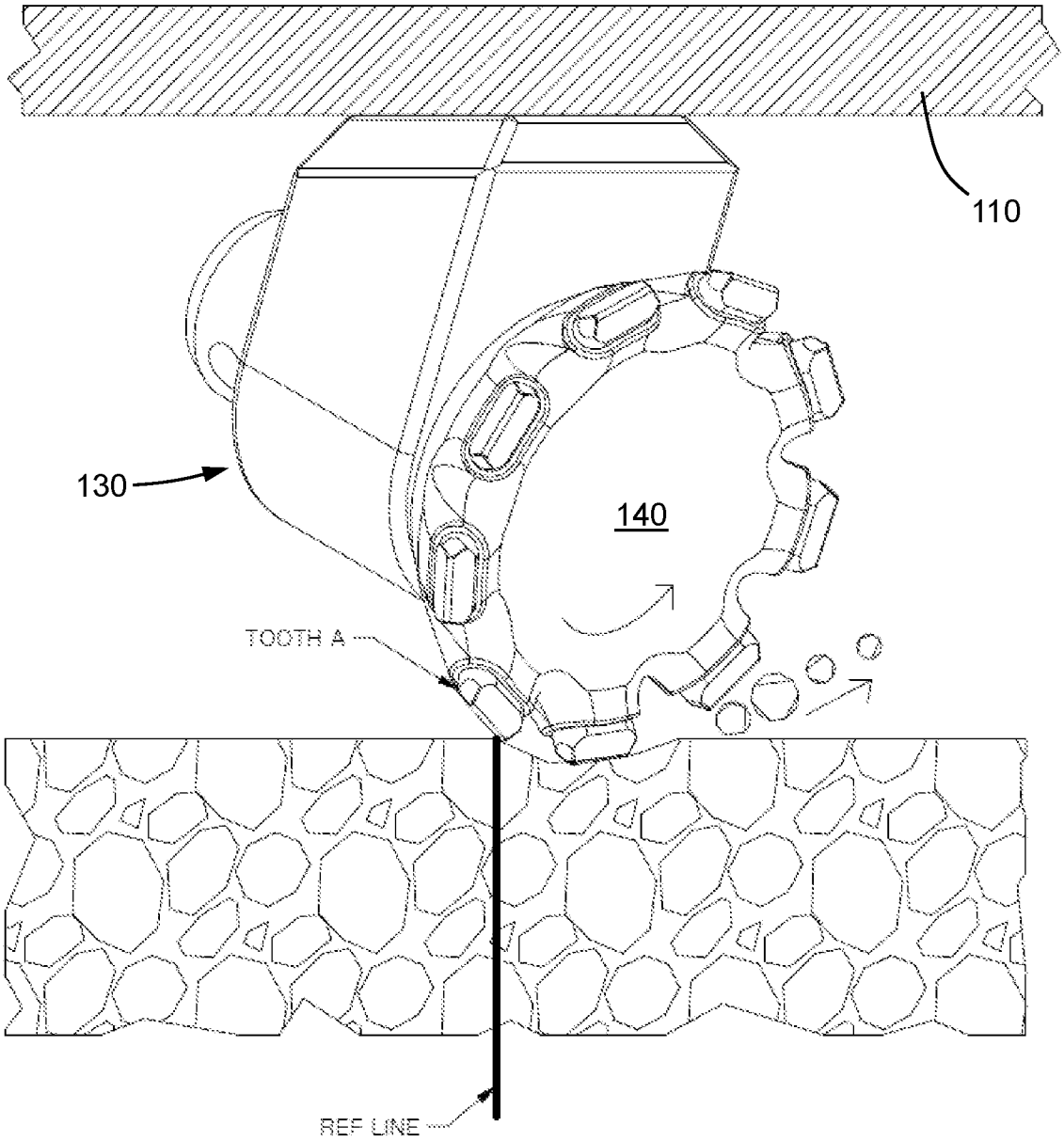
FIGS. 12A-12D illustrate forward movement of a rotary cutter secured to the drum as the drum rotates.

FIG. 12A illustrates a position where tooth "A" of rotary cutter 140 initially makes contact with the surface of the material being profiled. The point or location of tooth "A" where tooth "A" makes initial surface contact with the material being profiled is referred to in FIGS. 12A-12D as a "reference" line.

Figure 12B:
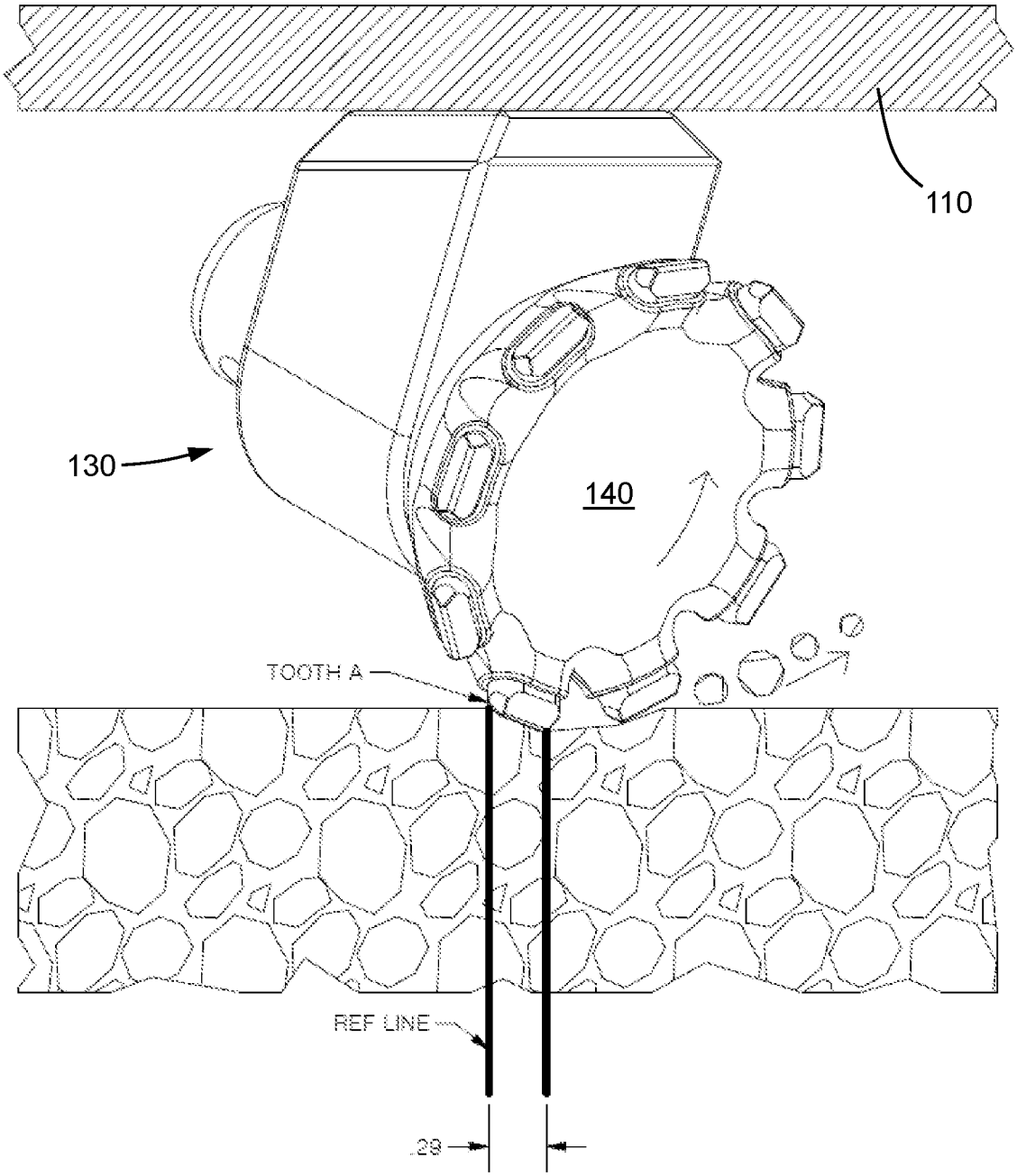

FIG. 12B illustrates the position of tooth "A" as the cutter drum continues to rotate and move the cutter mount 130 that holds rotary cutter 140. In FIG. 12B, tooth "A" is fully engaged with the material being profiled. As tooth "A" rotates, it also moves laterally and downward with respect to the material being profiled and the centerline axis of the cutter drum, in view of the rotation of the rotary cutter 140 with respect to the cylindrical body 110 of the cutter drum 100. The amount of tooth "A's" lateral and downward movement between FIG. 12A and FIG. 12B is illustrated by the second vertical line to the right of the original reference line.

Figure 12C:
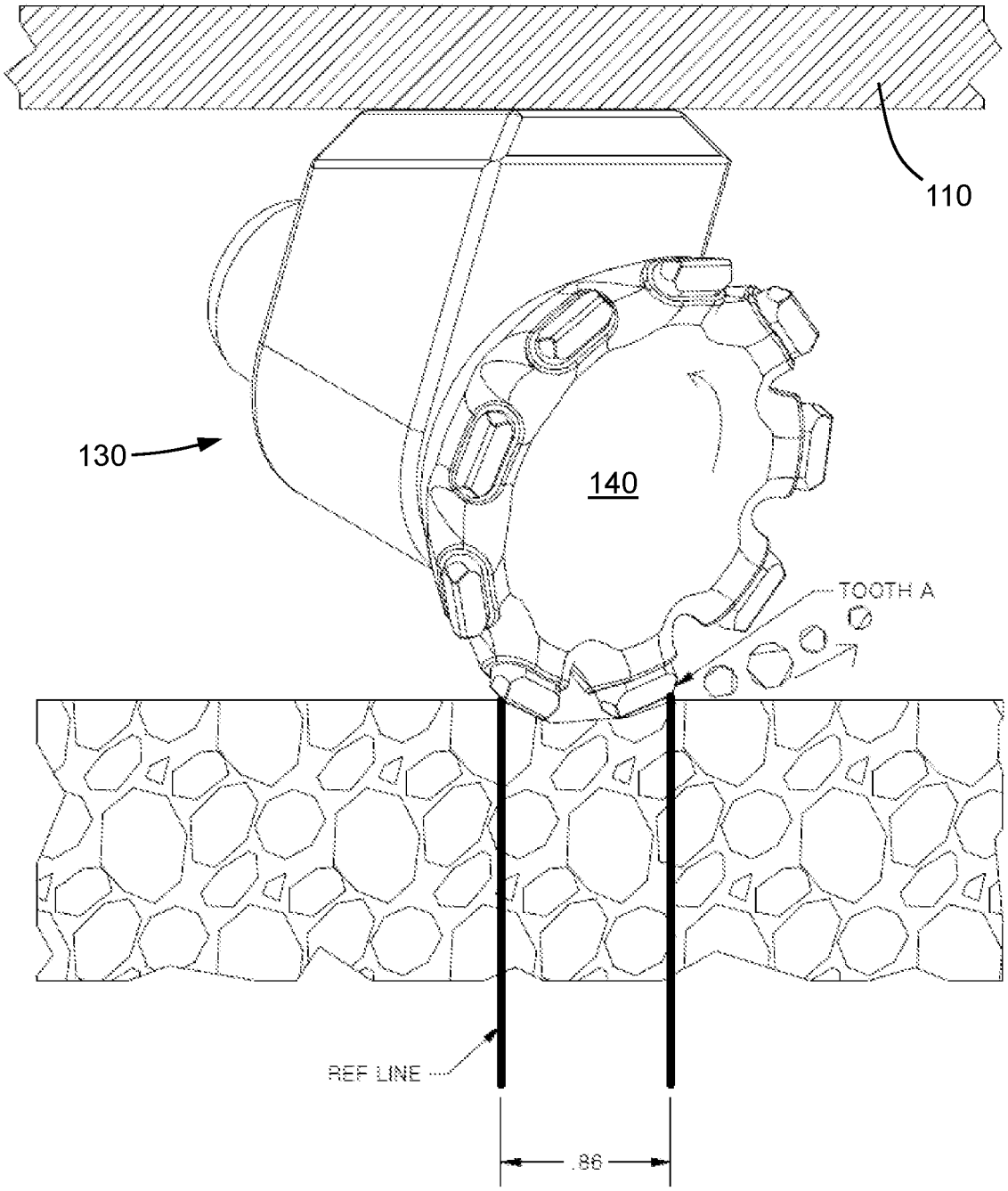

FIG. 12C illustrates the position of tooth "A" as the cutter drum continues to rotate further and move the cutter mount 130 that holds rotary cutter 140 . . . . Tooth "A" now begins to rotate out of the material being profiled. As tooth "A" has rotated, tooth "A" has also moved laterally and upward further from the centerline axis of the cylindrical body 110 and has begun to move vertically away from the material being profiled. As the combined lateral and vertical movement of tooth "A" is exerted on the material being profiled, some of the material is pulled away from the surface. The amount of lateral movement of tooth "A" is illustrated by the second vertical line further to the right of the original reference line. The amount of vertical tooth movement from beginning to end as tooth "A" rotates is illustrated by the distance from the top of the surface being profiled to the lowest point at which tooth "A" is from this top surface.

Figure 12D:
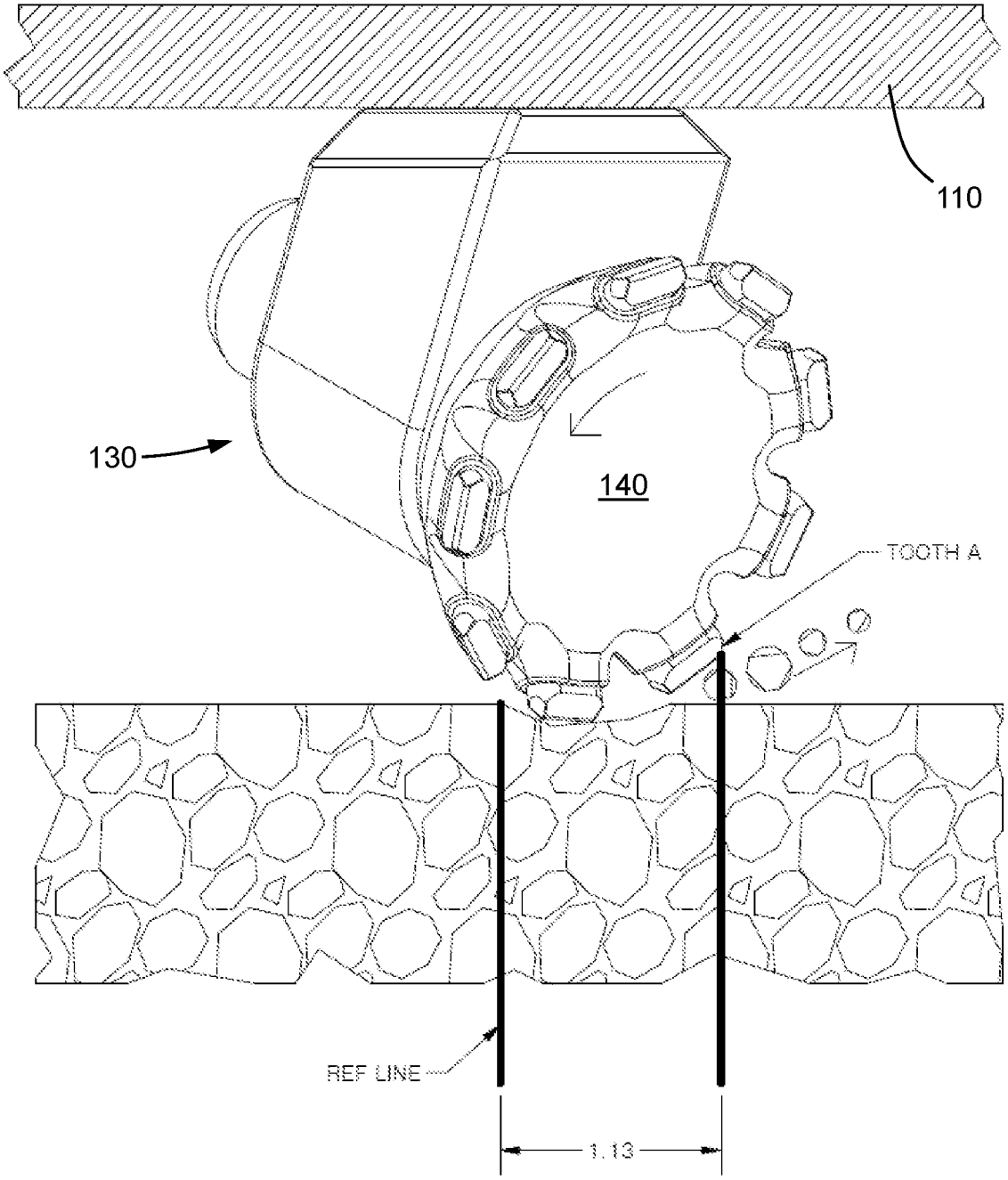

FIG. 12D illustrates the position of tooth "A" as the cutter drum continues to rotate even further and move the cutter mount 130 that holds rotary cutter 140. Tooth "A" has now moved above the surface being profiled and no longer engages this surface. At this point subsequent teeth following tooth "A" around the circumference of the rotary cutter 140 that is carried by the cutter mount 130 and cutter drum follow tooth "A" successively and continuously repeat the surface engaging and disengaging process of the teeth that is illustrated in FIGS. 12A through 12D with respect to tooth "A".

In summary, as the rotary cutter of the disclosure rolls over a material being cut, due to the attack angle of the rotary cutter teeth which are predisposed towards the surface of the material being profiled, as the rotary cutter rolls at an angle to the forward movement of the rotary cutter through the material being profiled, the teeth of the rotary cutter are presupposed laterally to the forward line of action of the rotary cutter. As a result, the teeth slightly grip the material being rolled over and profiled and the teeth of the rotary cutter then lift the material up and away from the surface that the cutter is engaging. This tooth lifting action takes the form of a wedge and rolls apart the material being profiled.

As used herein, unless otherwise indicated herein, the terms "first," "second," etc. are used merely as labels. These identifiers are not intended to impose hierarchical, ordinal, or positional requirements on the items to which these terms refer. Moreover, reference to a "first" feature or item does not require the existence of a "second" or higher-numbered item.

Unless otherwise indicated herein, the term "or" is inclusive. For example, a description of a device as including a first component or a second component should be understood to include devices including the first component without the second component, devices including the second component without the first component, and devices including both the first component and the second component.

As used herein, the description of a system, apparatus, device, structure, article, element, component, or hardware as being "configured to" perform a specified function is indeed capable of performing the specified function without any alteration, rather than merely having potential to perform the specified function after further modification. In other words, the system, apparatus, structure, article, element, component, or hardware "configured to" perform the specified function is specifically selected, created, implemented, utilized, programmed, and/or designed for the purpose of performing the specified function. Further, as used herein, the term "configured to" denotes existing characteristics of the system, apparatus, structure, article, element, component, or hardware which enable the system, apparatus, structure, article, element, component, or hardware to perform the specified function without further modification.

While various aspects and embodiments have been disclosed herein, it will be apparent to those skilled in the art that various modifications and variations may be made to the devices and methods described here without departing from the scope of the disclosure. Accordingly, the present disclosure is intended to cover such modifications and variations of the disclosure, with the scope of the disclosure being set forth by the appended claims and their equivalents.

The invention claimed is:

1. A cutter drum for profiling a working surface, the cutter drum comprising:

a body extending along an axis from a first end to a second end, the body including an outer surface encircling the axis;

a plurality of first working elements disposed on the body, each of the first working elements comprising:

a cutter mount attached to the outer surface of the body, and a rotary cutter rotatably coupled to the cutter mount; and a plurality of second working elements coupled to the outer surface of the body, the second working elements having a different configuration than the first working elements, wherein the second working elements are configured to crush material of the working surface, wherein a ratio of the number of first working elements to the number of second working elements on the cutter drum is at least 4.

2. The cutter drum according to claim 1, wherein each of the second working elements is attached to the outer surface of the body by a respective mount.

3. The cutter drum according to claim 1, wherein each of the second working elements is a carbide pick.

4. The cutter drum according to claim 1, wherein the cutter drum includes a continuous central section extending over at least 50% of the cylindrical body along the axis of the cylindrical body, and wherein the central section is free of any second working elements.

5. The cutter drum according to claim 1, wherein each rotary cutter includes a front side and teeth disposed around a circumference of the front side.

6. The cutter drum according to claim 5, wherein each rotary cutter in a first group is canted at a side angle such that the front side of the rotary cutter faces a tangential direction of the cylindrical body so as to face a line of action of the rotary cutter as the cutter drum is rotated.

7. The cutter drum according to claim 6, wherein each rotary cutter in the first group is canted at a tilt angle such that the front side of the rotary cutter faces away from the circumferential outer surface of the cylindrical body.

8. The cutter drum according to claim 7, wherein the teeth of each rotary cutter are configured to follow a circular path with respect to the circumferential outer surface of the cylindrical body.

9. The cutter drum according to claim 1, wherein a back side of each rotary cutter includes a shaft that is rotatably held in one of the cutter mounts so as to form a freewheeling connection between the rotary cutter and the respective cutter mount.

10. The cutter drum according to claim 1, wherein the ratio of the number of first working elements to the number of second working elements on the cutter drum is at least 6.

11. The cutter drum according to claim 1, wherein the ratio of the number of first working elements to the number of second working elements on the cutter drum is at least 10.

12. A surface profiling machine comprising:

a vehicle propulsion system; and a cutter drum including:

a body extending along an axis from a first end to a second end, the body including an outer surface encircling the axis;

a plurality of first working elements disposed on the body, each of the first working elements comprising:

a cutter mount attached to the outer surface of the body, and a rotary cutter rotatably coupled to the cutter mount; and a plurality of second working elements coupled to the outer surface of the body, the second working elements having a different configuration than the first working elements, wherein the second working elements are configured to crush material of the working surface, wherein a ratio of the number of first working elements to the number of second working elements on the cutter drum is at least 4.

13. The surface profiling machine according to claim 12, wherein the vehicle propulsion system includes a wheel or track.

14. The surface profiling machine according to claim 13, wherein the cutter drum is positioned to profile the surface that supports the wheel or track.

15. The surface profiling machine according to claim 14, wherein the second working elements include carbide end picks disposed at opposing ends of the cylindrical body.

16. The surface profiling machine according to claim 12, wherein each of the second working elements is attached to the outer surface of the body by a respective mount.

17. The surface profiling machine according to claim 12, wherein the cutter drum includes a continuous central section extending over at least 50% of the cylindrical body along the axis of the cylindrical body, and wherein the central section is free of any second working elements.

18. A method of profiling a surface, the method comprising:

positioning a cutter drum against the surface, the cutter drum comprising:

a body extending along an axis from a first end to a second end, the body including an outer surface encircling the axis;

a plurality of first working elements disposed on the body, each of the first working elements comprising:

a cutter mount attached to the outer surface of the body, and a rotary cutter rotatably coupled to the cutter mount, and a plurality of second working elements coupled to the outer surface of the body, the second working elements having a different configuration than the first working elements, wherein the second working elements are configured to crush material of the working surface, wherein a ratio of the number of first working elements to the number of second working elements on the cutter drum is at least 4; and rotating the cutter drum against the surface such that the first working elements and second working elements engage the surface and remove portions of the surface.

19. The method according to claim 18, wherein the cutter drum includes a continuous central section extending over at least 50% of the cylindrical body along the axis of the cylindrical body, and wherein the central section is free of any second working elements.

20. The method according to claim 18, wherein rotating the cutter drum against the surface forms a cut profile, and wherein sides of the cut profile are formed by the second working elements.

* * * * *